US009932735B1

(12) United States Patent
Biasucci et al.

(10) Patent No.: US 9,932,735 B1
(45) Date of Patent: Apr. 3, 2018

(54) HEADER BOARD BRACKET

(71) Applicants: Joey Biasucci, Toronto (CA); Sam Biasucci, Toronto (CA)

(72) Inventors: Joey Biasucci, Toronto (CA); Sam Biasucci, Toronto (CA)

( * ) Notice: Subject to any disclaimer, the term of this patent is extended or adjusted under 35 U.S.C. 154(b) by 0 days.

(21) Appl. No.: 15/584,143

(22) Filed: May 2, 2017

(51) Int. Cl.
*E04B 1/26* (2006.01)

(52) U.S. Cl.
CPC .... *E04B 1/2612* (2013.01); *E04B 2001/2644* (2013.01)

(58) Field of Classification Search
CPC ..... E04B 2001/2644; E04B 1/2612
See application file for complete search history.

(56) References Cited

U.S. PATENT DOCUMENTS 3,972,168 A * 8/1976 Allen ..... E04B 1/4114 52/442
4,296,048 A * 10/1981 Sim ..... E04H 5/12 248/544
4,341,051 A * 7/1982 Sim ..... E04H 5/12 52/250
4,347,015 A * 8/1982 Olashaw ..... F16B 12/50 403/171
4,584,813 A * 4/1986 Hudson ..... E04B 1/2612 248/214
4,947,600 A * 8/1990 Porter ..... E04F 13/0862 52/235
4,965,980 A 10/1990 Leavens
5,058,358 A 10/1991 Stratton
5,205,942 A * 4/1993 Fitzgerald ..... E01C 19/502 249/14
5,345,727 A 9/1994 McCrea
5,743,672 A * 4/1998 Cline ..... A47C 19/005 403/231
5,746,421 A * 5/1998 Bowerman ..... E04D 13/158 269/41
5,794,395 A * 8/1998 Reed ..... E04F 11/1812 403/230
5,836,131 A 11/1998 Viola et al.
5,979,130 A * 11/1999 Gregg ..... E04B 1/2604 403/190
6,073,405 A * 6/2000 Kasai ..... E04B 1/2403 403/270
6,301,855 B1 10/2001 Aerni
6,311,449 B1 * 11/2001 Morse ..... E04B 1/003 52/236.9

(Continued)

*Primary Examiner* — Rodney Mintz

(57) ABSTRACT

A header board bracket for coupling a deck to a structure includes a brace that comprises first, second, third, and fourth plates. The second plate is coupled to and extends perpendicularly between bottoms of the first and third plates. The first plate is dimensionally longer than the third plate. The fourth plate is scalene right triangularly shaped. The fourth plate is coupled to and extends perpendicularly from the first and second plates. The third and fourth plates define a slot. Each of a plurality of holes that is positioned through the first plate is configured to insert a connector to couple the brace to a structure. A plurality of the braces is configured to couple to the structure with the braces horizontally aligned. The slots of the braces are configured to insert a board to retain the board as a deck that comprises the board floats relative to the structure.

14 Claims, 4 Drawing Sheets

(56) References Cited

U.S. PATENT DOCUMENTS 6,463,710 B1 * 10/2002 Barnhart ..... E04B 5/12 248/250
6,817,157 B2 11/2004 Bourque
6,931,813 B2 * 8/2005 Collie ..... E04B 7/045 52/702
7,197,857 B1 * 4/2007 Alvarado ..... E04B 1/34342 52/169.12
D556,014 S * 11/2007 Wurdack ..... D8/349
8,151,535 B1 * 4/2012 Thompson ..... E04B 1/2608 52/712
8,234,827 B1 * 8/2012 Schroeder, Sr. ..... E04B 1/24 52/334
8,272,183 B2 * 9/2012 Dodge ..... E04D 15/04 248/300
8,667,765 B1 * 3/2014 McCarthy ..... E04F 13/0841 248/301
8,733,505 B2 5/2014 Paquet et al.
D730,545 S 5/2015 Stauffer et al.
9,133,588 B2 * 9/2015 Stroyer ..... E01D 2/00
9,151,058 B1 * 10/2015 Leathe ..... E04B 1/2608
2001/0025465 A1 * 10/2001 Osfolk ..... E02B 3/068 52/650.3
2004/0107653 A1 * 6/2004 Collie ..... E04B 7/045 52/92.2
2004/0237443 A1 * 12/2004 Haley ..... E04F 13/0823 52/545
2007/0028533 A1 * 2/2007 Stroyer ..... E01D 2/00 52/126.6
2008/0110107 A1 * 5/2008 Decker ..... E04F 21/185 52/127.2
2010/0307094 A1 * 12/2010 Spyrou ..... E04B 1/003 52/489.1
2012/0073232 A1 * 3/2012 Dodge ..... E04D 15/04 52/582.1
2012/0177435 A1 * 7/2012 Curtis ..... E04F 15/142 403/28

* cited by examiner

HEADER BOARD BRACKET

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to brackets and more particularly pertains to a new bracket for coupling a deck to a structure.

BRIEF SUMMARY OF THE INVENTION

An embodiment of the disclosure meets the needs presented above by generally comprising a brace that comprises first, second, third, and fourth plates. The second plate is coupled to and extends perpendicularly between bottoms of the first and third plates. The first plate is dimensionally longer than the third plate. The fourth plate is scalene right triangularly shaped. The fourth plate is coupled to and extends perpendicularly from the first and second plates. The third and fourth plates define a slot. Each of a plurality of holes that is positioned through the first plate is configured to insert a connector to couple the brace to a structure. A plurality of the braces is configured to couple to the structure with the braces horizontally aligned. The slots of the braces are configured to insert a board to retain the board as a deck that comprises the board floats relative to the structure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
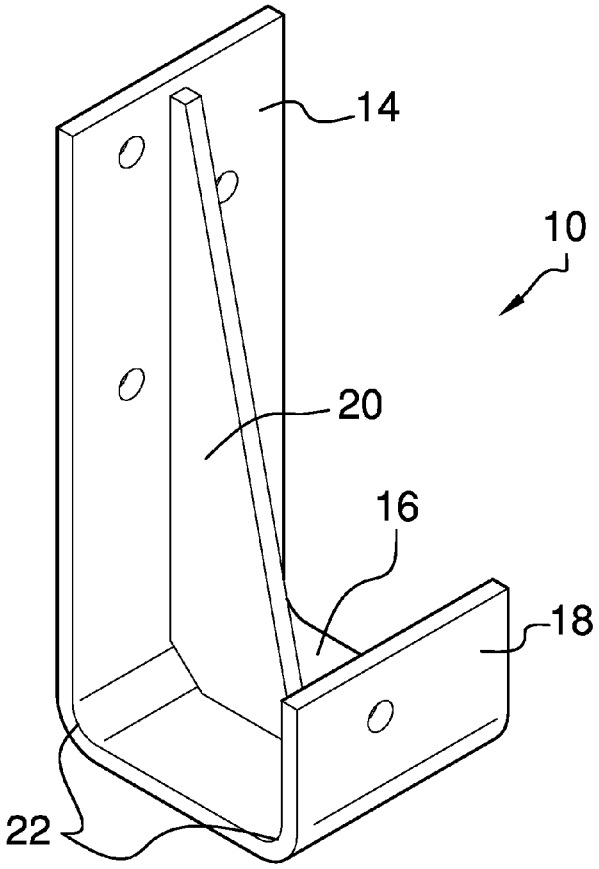
FIG. 1 is an isometric perspective view of a header board bracket according to an embodiment of the disclosure.
Figure 2:
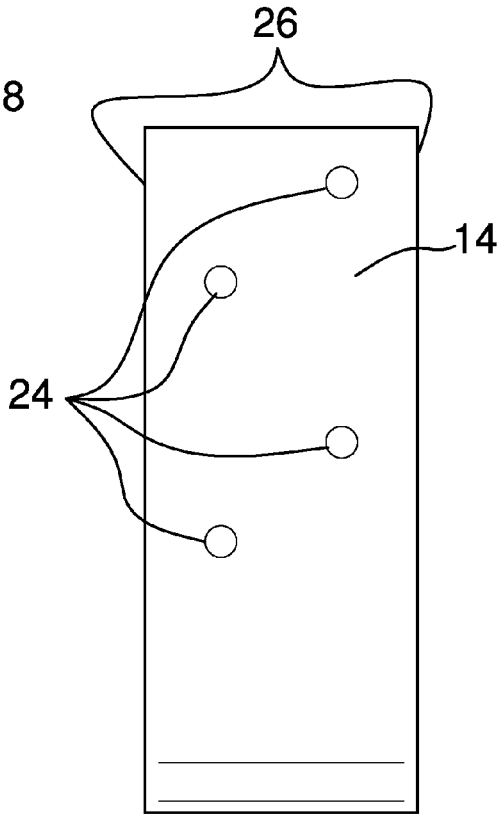
FIG. 2 is a back view of an embodiment of the disclosure.
Figure 3:
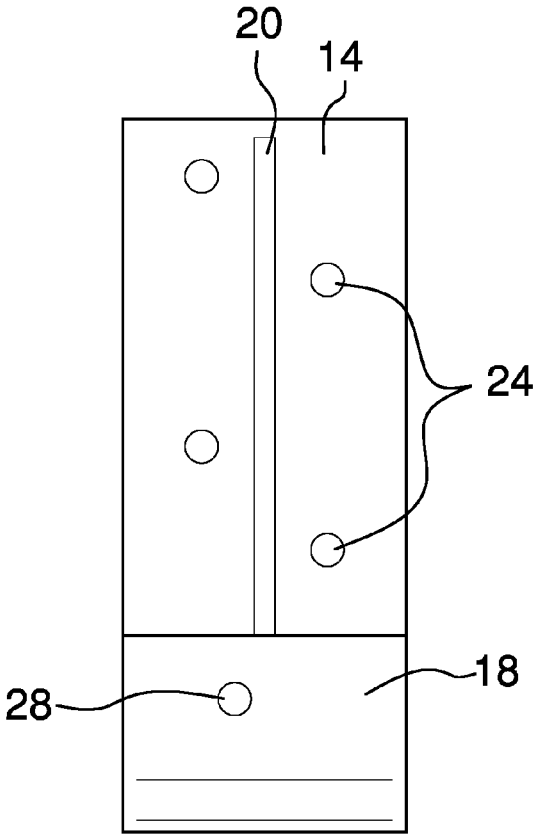
FIG. 3 is a front view of an embodiment of the disclosure.
Figure 4:
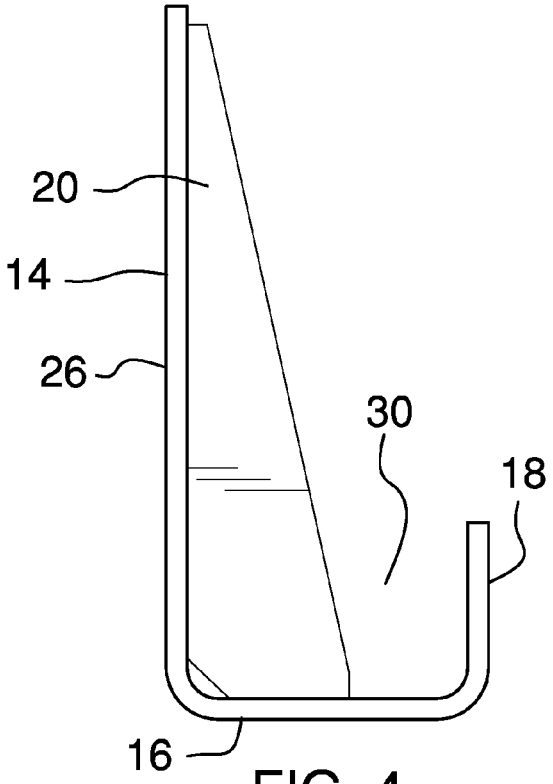
FIG. 4 is a side view of an embodiment of the disclosure.
Figure 5:
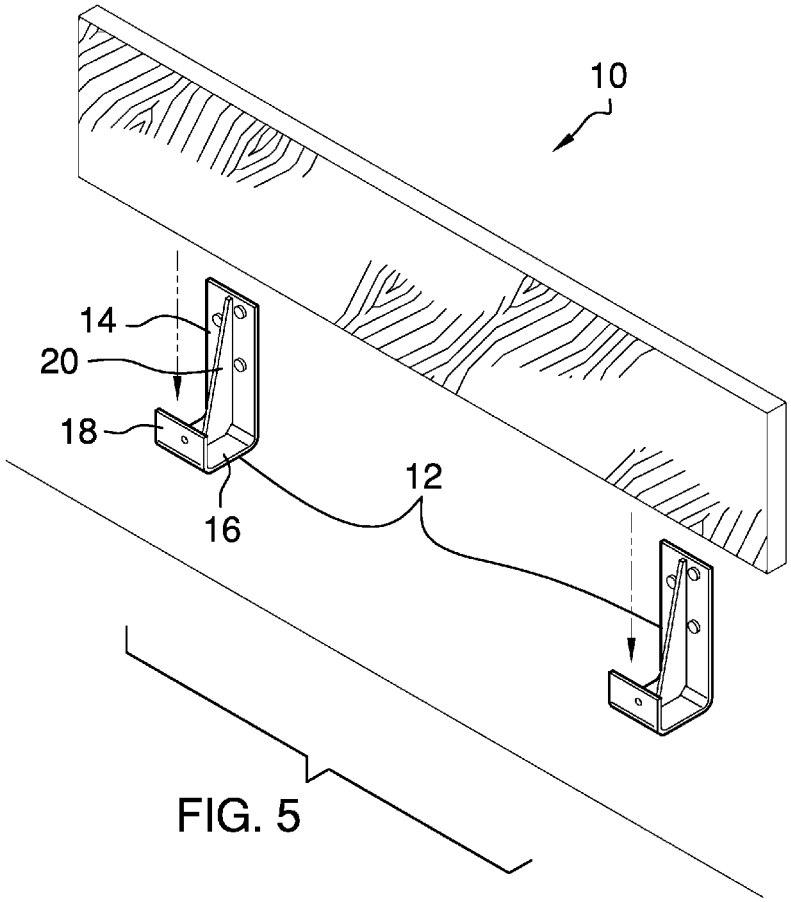
FIG. 5 is an in-use view of an embodiment of the disclosure.
Figure 6:
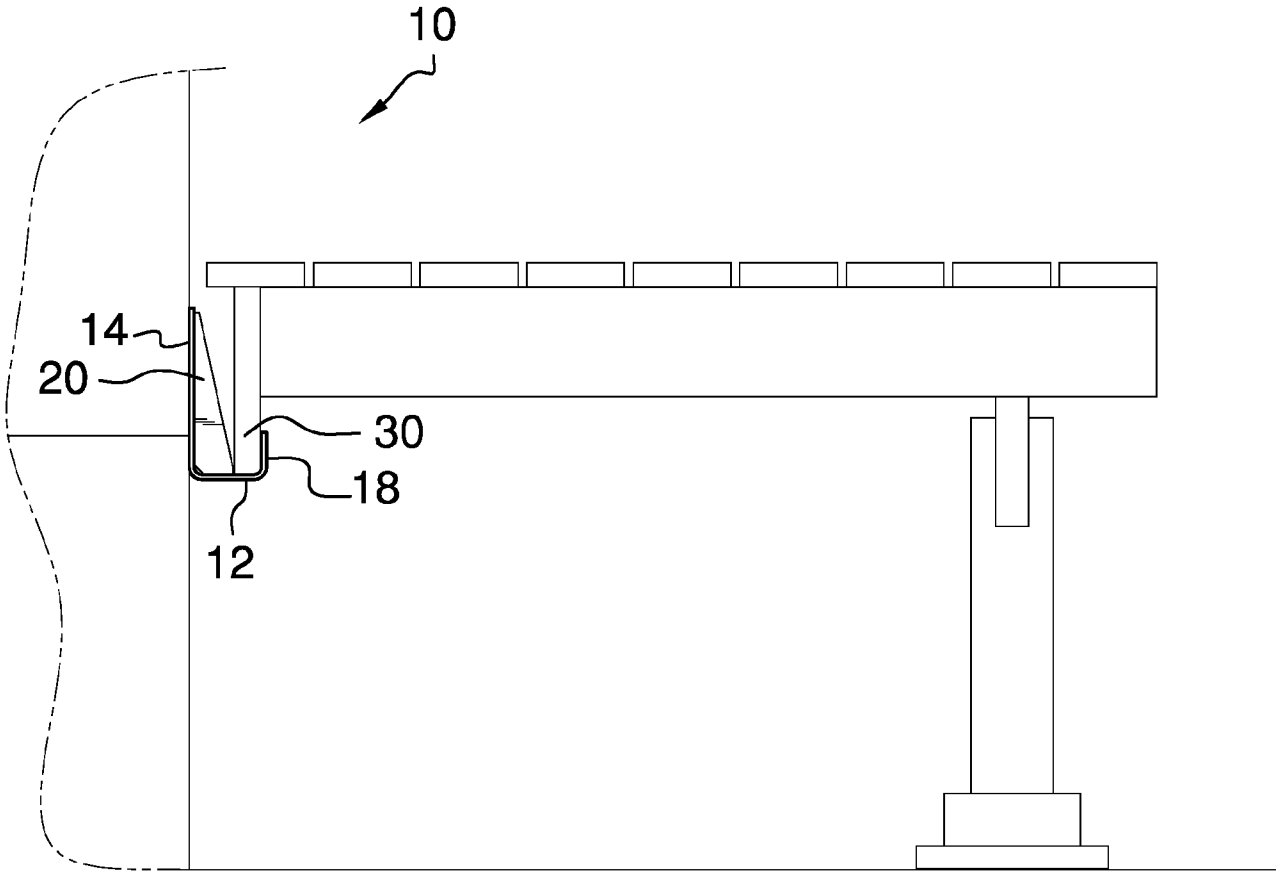
FIG. 6 is an in-use view of an embodiment of the disclosure.

With reference now to the drawings, and in particular to FIGS. 1 through 6 thereof, a new bracket embodying the principles and concepts of an embodiment of the disclosure and generally designated by the reference numeral 10 will be described.

As best illustrated in FIGS. 1 through 6, the header board bracket 10 generally comprises a brace 12 that comprises a first plate 14, a second plate 16, a third plate 18, and a fourth plate 20. The second plate 16 is coupled to and extends substantially perpendicularly between bottoms 22 of the first plate 14 and the third plate 18. The first plate 14 is dimensionally longer than the third plate 18 such that the brace 12 is substantially J-shaped. The fourth plate 20 is scalene right triangularly shaped. The fourth plate 20 is coupled to and extends perpendicularly from the first plate 14 and the second plate 16.

The third plate 18 and the fourth plate 20 define a slot 30. The slot 30 is substantially complementary to a board, such as header board for a deck. In one embodiment, the fourth plate 20 is positioned equally distant from opposing edges 26 of the first plate 14. In another embodiment, the brace 12 comprises metal. In yet another embodiment, the brace 12 comprises steel.

In one embodiment, the brace 12 has a height of between 15.0 and 30.0 centimeters (5.9 and 11.8 inches), a depth of between 6.0 and 14.0 centimeters (2.4 and 5.5 inches), and a width of between 5.5 and 13.0 centimeters (2.2 and 5.1 inches). The third plate 18 has a height of between 4.0 and 10.0 centimeters (1.6 and 3.9 inches). The first plate 14, the second plate 16, the third plate 18, and the fourth plate 20 each have a thickness of between 45.0 and 85.0 millimeters (1.8 and 3.3 inches).

In another embodiment, the brace 12 has a height of between 20.0 and 25.0 centimeters (7.9 and 9.8 inches), a depth of between 7.5 and 12.5 centimeters (3.0 and 4.9 inches), and a width of between 7.0 and 11.0 centimeters (2.8 and 4.3 inches). The third plate 18 has a height of between 6.0 and 7.0 centimeters (2.4 and 2.8 inches). The first plate 14, the second plate 16, the third plate 18, and the fourth plate 20 each have a thickness of between 55.0 and 75.0 millimeters (2.2 and 3.0 inches).

In yet another embodiment, the brace 12 has a height of 22.9 centimeters (9.0 inches), a depth of 10.2 centimeters (4.0 inches), and a width of 8.89 centimeters (3.5 inches). The third plate 18 has a height of 6.35 centimeters (2.5 inches). The first plate 14, the second plate 16, the third plate 18, and the fourth plate 20 each have a thickness of 63.5 millimeters (25 inches).

A plurality of holes 24 is positioned through the first plate 14. The holes 24 are positioned through the first plate 14 such that each hole 24 is configured to insert a respective connector, such as a lag bolt, through the hole 24 to couple the brace 12 to a structure. A plurality of the braces 12 is configured to couple to the structure. The braces 12 are substantially horizontally aligned. The slots 30 of the braces 12 are configured to insert the board to retain the board as a deck that comprises the board floats relative to the structure due to frost heave.

In one embodiment, the plurality of holes 24 comprises four holes 24 that are positioned two-apiece proximate to the opposing edges 26 of the first plate 14. In another embodiment, the holes 24 are staggered. In yet another embodiment, the holes 24 are circularly shaped.

In one embodiment, a penetration 28 is positioned through the third plate 18. The penetration 28 is configured to insert a coupler, such as a screw, through the penetration 28 into the board to couple the board to the brace 12 to prevent uplift of the deck that is coupled to the brace 12. In another embodiment, the penetration 28 is substantially centrally positioned on the third plate 18. In yet another embodiment, the penetration 28 is circularly shaped.

In use, the holes 24 that are positioned through the first plate 14 are each configured to insert the respective connector, such as the lag bolt, through the hole 24 to couple the brace 12 to the structure. The plurality of the braces 12 is configured to couple to the structure so that the braces 12 are substantially horizontally aligned. The slots 30 of the braces 12 are configured to insert the board to retain the board as the deck that comprises the board floats relative to the structure due to the frost heave. Each penetration 28 is positioned through a respective third plate 18 such that each penetration 28 is configured to insert a respective coupler, such as the screw, through the penetration 28 into the board to couple the board to the brace 12 to prevent uplift of the deck.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A header board bracket comprising:

a brace comprising a first plate, a second plate, a third plate and a fourth plate, each of said first plate, said second plate, said third plate, and said fourth plate being planar, said second plate being coupled to and extending substantially perpendicularly between bottoms of said first plate and said third plate, said first plate being dimensionally longer than said third plate such that said brace is substantially J-shaped, said fourth plate being scalene right triangularly shaped, said fourth plate being coupled to and extending perpendicularly from said first plate and said second plate such that said third plate and said fourth plate are spaced apart and do not contact one another, said third and fourth plates define a slot therebetween with a hypotenuse side of said fourth plate extending simultaneously upwardly from said second plate and away from said third plate, said slot being substantially complementary to a board;

a plurality of holes positioned through said first plate; and wherein said holes are positioned through said first plate such that each said hole is configured for inserting a respective connector through said hole for coupling said brace to a structure, wherein a plurality of said braces is configured for coupling to the structure such that said braces are substantially horizontally aligned, wherein said slots of said braces are configured for inserting the board for retaining the board as a deck comprising the board floats relative to the structure due to frost heave.

2. The bracket of claim 1, further including said fourth plate being positioned equally distant from opposing edges of said first plate.

3. The bracket of claim 1, further including said holes being circularly shaped.

4. The bracket of claim 1, further including said plurality of holes comprising four said holes positioned two-apiece proximate to opposing edges of said first plate.

5. The bracket of claim 4, further including said holes being staggered.

6. The bracket of claim 1, further including said brace comprising metal.

7. The bracket of claim 6, further including said brace comprising steel.

8. The bracket of claim 1, further including a penetration positioned through said third plate, wherein said penetration is positioned through said third plate such that said penetration is configured for inserting a coupler through said penetration into the board for coupling the board to said brace for preventing uplift of the deck coupled to said brace.

9. The bracket of claim 8, further including said penetration being substantially centrally positioned on said third plate.

10. The bracket of claim 8, further including said penetration being circularly shaped.

11. The bracket of claim 1, further comprising:

said brace having a height of between 15.0 and 30.0 centimeters (5.9 and 11.8 inches), a depth of between 6.0 and 14.0 centimeters (2.4 and 5.5 inches), and a width of between 5.5 and 13.0 centimeters (2.2 and 5.1 inches);

said third plate having a height of between 4.0 and 10.0 centimeters (1.6 and 3.9 inches); and said first plate, said second plate, said third plate and said fourth plate each having a thickness of between 45.0 and 85.0 millimeters (1.8 and 3.3 inches).

12. The bracket of claim 11, further comprising:

said brace having a height of between 20.0 and 25.0 centimeters (7.9 and 9.8 inches), a depth of between 7.5 and 12.5 centimeters (3.0 and 4.9 inches), and a width of between 7.0 and 11.0 centimeters (2.8 and 4.3 inches);

said third plate having a height of between 6.0 and 7.0 centimeters (2.4 and 2.8 inches); and said first plate, said second plate, said third plate and said fourth plate each having a thickness of between 55.0 and 75.0 millimeters (2.2 and 3.0 inches).

13. The bracket of claim 12, further comprising:

said brace having a height of 22.9 centimeters (9.0 inches), a depth of 10.2 centimeters (4.0 inches), and a width of 8.89 centimeters (3.5 inches);

said third plate having a height of 6.35 centimeters (2.5 inches); and said first plate, said second plate, said third plate and said fourth plate each having a thickness of 63.5 millimeters (25 inches).

14. A header board bracket comprising:

a brace comprising a first plate, a second plate, a third plate and a fourth plate, said second plate being coupled to and extending substantially perpendicularly between bottoms of said first plate and said third plate, said first plate being dimensionally longer than said third plate such that said brace is substantially J-shaped, said fourth plate being scalene right triangularly shaped, said fourth plate being coupled to and extending perpendicularly from said first plate and said second plate such that said third plate and said fourth plate define a slot, said fourth plate being positioned equally distant from opposing edges of said first plate, said slot being substantially complementary to a board said brace comprising metal, said brace comprising steel, said brace having a height of between 15.0 and 30.0 centimeters (5.9 and 11.8 inches), a depth of between 6.0 and 14.0 centimeters (2.4 and 5.5 inches), and a width of between 5.5 and 13.0 centimeters (2.2 and 5.1 inches), said third plate having a height of between 4.0 and 10.0 centimeters (1.6 and 3.9 inches), said first plate, said second plate, said third plate and said fourth plate each having a thickness of between 45.0 and 85.0 millimeters (1.8 and 3.3 inches), said brace having a height of between 20.0 and 25.0 centimeters (7.9 and 9.8 inches), a depth of between 7.5 and 12.5 centimeters (3.0 and 4.9 inches), and a width of between 7.0 and 11.0 centimeters (2.8 and 4.3 inches), said third plate having a height of between 6.0 and 7.0 centimeters (2.4 and 2.8 inches), said first plate, said second plate, said third plate and said fourth plate each having a thickness of between 55.0 and 75.0 millimeters (2.2 and 3.0 inches), said brace having a height of 22.9 centimeters (9.0 inches), a depth of 10.2 centimeters (4.0 inches), and a width of 8.89 centimeters (3.5 inches), said third plate having a height of 6.35 centimeters (2.5 inches), said first plate, said second plate, said third plate and said fourth plate each having a thickness of 63.5 millimeters (25 inches);

a plurality of holes positioned through said first plate, wherein said holes are positioned through said first plate such that each said hole is configured for inserting a respective connector through said hole for coupling said brace to a structure, wherein a plurality of said braces is configured for coupling to the structure such that said braces are substantially horizontally aligned, wherein said slots of said braces are configured for inserting the board for retaining the board as a deck comprising the board floats relative to the structure due to frost heave, said plurality of holes comprising four said holes positioned two-apiece proximate to opposing edges of said first plate, said holes being staggered, said holes being circularly shaped;

a penetration positioned through said third plate, wherein said penetration is positioned through said third plate such that said penetration is configured for inserting a coupler through said penetration into the board for coupling the board to said brace for preventing uplift of the deck coupled to said brace, said penetration being substantially centrally positioned on said third plate, said penetration being circularly shaped; and wherein said holes are positioned through said first plate such that each said hole is configured for inserting the respective connector through said hole for coupling said brace to the structure, wherein said plurality of said braces is configured for coupling to the structure such that said braces are substantially horizontally aligned, wherein said slots of said braces are configured for inserting the board for retaining the board as the deck comprising the board floats relative to the structure due to the frost heave, wherein each said penetration is positioned through a respective said third plate such that each said penetration is configured for inserting a respective coupler through said penetration into the board for coupling the board to said brace for preventing uplift of the deck.

* * * * *